US009518781B2

(12) United States Patent
Maddalena et al.

(10) Patent No.: US 9,518,781 B2
(45) Date of Patent: Dec. 13, 2016

(54) PANEL COOLED WITH A FLUID FOR METALLURGIC FURNACES, A COOLING SYSTEM FOR METALLURGIC FURNACES COMPRISING SUCH A PANEL AND METALLURGIC FURNACE INCORPORATING THEM

(75) Inventors: Fabio Maddalena, Milan (IT); Luciano Camisani, Milan (IT); Silvio Maria Reali, Milan (IT)

(73) Assignee: TENOVA S.p.A., Milan (IT)

( * ) Notice: Subject to any disclaimer, the term of this patent is extended or adjusted under 35 U.S.C. 154(b) by 751 days.

(21) Appl. No.: 13/813,768

(22) PCT Filed: Aug. 3, 2011

(86) PCT No.: PCT/IB2011/001829

§ 371 (c)(1),
(2), (4) Date: Apr. 9, 2013

(87) PCT Pub. No.: WO2012/017312

PCT Pub. Date: Feb. 9, 2012

(65) Prior Publication Data

US 2013/0206358 A1 Aug. 15, 2013

(30) Foreign Application Priority Data

Aug. 6, 2010 (IT) ..... MI2010A1523

(51) Int. Cl.
*F27D 9/00* (2006.01)
*C21B 7/10* (2006.01)
(Continued)

(52) U.S. Cl.
CPC . *F27D 9/00* (2013.01); *C21B 7/10* (2013.01); *C21B 7/20* (2013.01); *F27B 3/24* (2013.01); *F27D 1/12* (2013.01)

(58) Field of Classification Search
CPC ..... C21B 7/10; C21B 7/20; F27D 9/00; F27D 1/12; F27B 3/24
(Continued)

(56) References Cited

U.S. PATENT DOCUMENTS 3,881,860 A * 5/1975 Brandenburg ..... C21B 7/10 266/193
4,553,245 A 11/1985 Kerr
(Continued)

FOREIGN PATENT DOCUMENTS

EP 1 160 531 12/2001
FR 1 238 375 8/1960
(Continued)

OTHER PUBLICATIONS

International Search Report Issued Dec. 22, 2011 in PCT/IB11/01829 Filed Aug. 3, 2011.

*Primary Examiner* — Roy King
*Assistant Examiner* — Michael Aboagye
(74) *Attorney, Agent, or Firm* — Oblon, McClelland, Maier & Neustadt, L.L.P.

(57) ABSTRACT

A panel cooled with a fluid, for metallurgic furnaces, includes a first chamber having a face which, in assembly conditions, is configured to face an interior of a metallurgic furnace and an opposite face in thermal contact with a face of a second chamber whose opposed face is configured to face, in assembly conditions, an external part of the metallurgic furnace. The first and second chambers are mutually independent. The first and second chambers each include an inlet and outlet of a cooling fluid. The panel has a first working configuration in which the first chamber is passed by a first cooling fluid and the second chamber is passed by a second cooling fluid different from the first cooling fluid, and a second working configuration in which the first
(Continued)

chamber is passed by the second cooling fluid and the second chamber is passed by the first cooling fluid.

10 Claims, 3 Drawing Sheets

(51) Int. Cl.
*C21B 7/20* (2006.01)
*F27B 3/24* (2006.01)
*F27D 1/12* (2006.01)

(58) Field of Classification Search
USPC ..... 266/194, 193, 90, 99, 241, 267; 432/83; 165/11.1, 56, 169, 101, 297
See application file for complete search history.

(56) References Cited

U.S. PATENT DOCUMENTS 6,059,028 A * 5/2000 Kincheloe ..... C21B 7/10 165/101
6,090,342 A * 7/2000 Sumigama ..... C21B 7/12 266/193

FOREIGN PATENT DOCUMENTS

| | | | | |
|---|---|---|---|---|
| JP | 64 54195 | | 3/1989 | |
| JP | 05039517 | * | 2/1993 | ..... C21B 7/20 |
| WO | 00 26419 | | 5/2000 | |

* cited by examiner

PANEL COOLED WITH A FLUID FOR METALLURGIC FURNACES, A COOLING SYSTEM FOR METALLURGIC FURNACES COMPRISING SUCH A PANEL AND METALLURGIC FURNACE INCORPORATING THEM

TECHNICAL FIELD

The present invention refers to a panel cooled with a fluid and a cooling system comprising such a panel for applications in metallurgic furnaces, in particular electric arc-furnaces (EAF) for the production of steel.

The present invention also refers to a metallurgic furnace, in particular an electric arc-furnace (EAF) for the production of steel, incorporating such a panel or such a cooling system.

TECHNICAL BACKGROUND

As it is known, metallurgic furnaces and, in particular, electric arc-furnaces for the production of steel of the older generation comprise a metal vat, in turn comprising a basin or crucible, a shell and a dome, coated inside with refractory material which, due to thermal, mechanical and chemical stress suffered during the operation cycles of the furnace, can suffer from erosion and damage.

In more modern metallurgic furnaces, the walls that define the shell and that project above the basin or crucible for containment of the metal to be treated and possibly the upper closure dome are made with metal panels that are cooled with water.

During the operation of the furnace, operation that, as known, is typically intermittent or discontinuous, such panels cyclically undergo mechanical, thermal and chemical stress, which, over time, damage their structural integrity, leading, for example, to the formation of cracks and fissures.

In particular, during the step of loading the metal to be treated, typically in the form of a scrap metal, the panels and, in particular, the face thereof facing the interior of the furnace is subjected to loads and mechanical actions. During the melting, formation and treatment steps of the metal bath, on the other hand, the panels are exposed to the high temperatures that are reached inside the furnace.

As already mentioned, the strength and the cyclicity of the mechanical, thermal and also chemical stress, damage the structural integrity of the panels and substantially reduce the average life span, making it necessary for there to be frequent maintenance or replacement operations.

The formation of fissures and cracks, moreover, causes there to be leakages of water that, if occur inside the furnace, can generate operation conditions that are extremely dangerous and that can lead to explosions.

Indeed, if the water that has come out from the panels is enclosed in the liquid metal bath or infiltrates into the refractory coating, the immediate evaporation, with an increase of the volume thereof, generates a sudden and rapid expansion and explosion. Events of this kind cause further damage of the furnace itself and jeopardise the safety of the work environment.

At the end of each operation cycle of the furnace, the integrity of the cooling panels is visually inspected by the workers.

During the operation of the furnace, on the other hand, possible leakages of water are detected and indicated through detection and signalling systems that are associated to the furnace.

It is known for there to be, for example, systems for detecting and signalling water leakages based upon the chemical analysis of the exhaust gases of the furnace of which they monitor the steam and hydrogen content.

Systems based upon the detection of the flow-rate, pressure and temperature of the water circulating in the panels are also known, like those for example described in US2009/0148800.

In the case in which the inspection of the panels carried out between two subsequent operation cycles of the furnace highlight the presence of a damaged panel or a water leakage is indicated during the operation of the furnace, it is necessary to provide for replacing and repairing it. Such maintenance interventions require the furnace to be stopped for a long time and, thus, a non-planned halt of the production, with consequent economic losses.

It is also possible for a water leakage to be indicated during critical operation steps of the furnace such as, for example, the tapping step. In such a case it is not possible to stop the furnace so as to intervene on the damaged panel before such an operation step has been completed. In such a situation, the flow of water which supplies the discussed panel is obstructed; this causes there to be further damage of the panel itself which, often, can no longer be repaired and restored.

From what has been described above it is clear that the panels, cooled with water, of the known type require frequent replacement and maintenance interventions, even not planned, which have a significant impact upon the productivity of a furnace, which must be stopped and kept off for the time necessary for carrying out such interventions.

The average life of the panels themselves, moreover, is limited and the relative maintenance and repairing interventions are expensive.

It is moreover obvious that the panels cooled with water of the known type can lead to dangerous operation conditions both for the integrity of the furnace itself, and for the workers.

SUMMARY

The purpose of the present invention is that of avoiding the aforementioned drawbacks of the prior art.

In the field of such a general purpose, the purpose of the present invention is that of providing a panel cooled with a fluid and a cooling system comprising such a panel for metallurgic furnaces which make it possible to extend the average life span of the panels themselves with respect to the average life span of known panels.

Another purpose of the present invention is that of providing a panel cooled with a fluid and a cooling system comprising such a panel for metallurgic furnaces which ensure safety of the operation conditions of the furnace.

A further purpose of the present invention is that of providing a panel cooled with a fluid and a cooling system comprising such a panel for metallurgic furnaces which make it possible to plan maintenance interventions without requiring the furnace itself to be suddenly halted for a long time, without affecting the productivity of the furnace.

Another purpose of the present invention is that of providing a panel cooled with a fluid and a cooling system comprising such a panel for metallurgic furnaces that require fewer and less expensive maintenance and repair interventions with respect to those generally required by panels and cooling systems for metallurgic furnaces of the known type.

Another purpose of the present invention is that of making a panel cooled with a fluid and a cooling system comprising such a panel for metallurgic furnaces that is particularly simple and functional, with low costs.

Yet another purpose of the present invention is that of providing a method for cooling a metallurgic furnace which makes it possible to efficiently cool down the furnace itself.

These purposes, according to the present invention, are achieved by making a panel cooled with a fluid for metallurgic furnaces as outlined in claim 1.

Further characteristics are foreseen in the dependent claims 2-8.

These purposes are moreover achieved by making a cooling system for metallurgic furnaces as outlined in claim 9.

Further characteristics are foreseen in the dependent claims 10-12.

Also a metallurgic furnace as defined in claims 13-16 forms the object of the present invention.

A method for cooling the walls of a metallurgic furnace as defined in claims 17 and 18 moreover, forms the object of the present invention.

BRIEF DESCRIPTION OF THE DRAWINGS

The characteristics and the advantages of a panel cooled with a fluid for metallurgic furnaces and of a cooling system for metallurgic furnaces comprising such a panel according to the present invention shall become clearer from the following description, given as an example and not for limiting purposes, with reference to the attached schematic drawings, in which.

DETAILED DESCRIPTION

Figure 3:
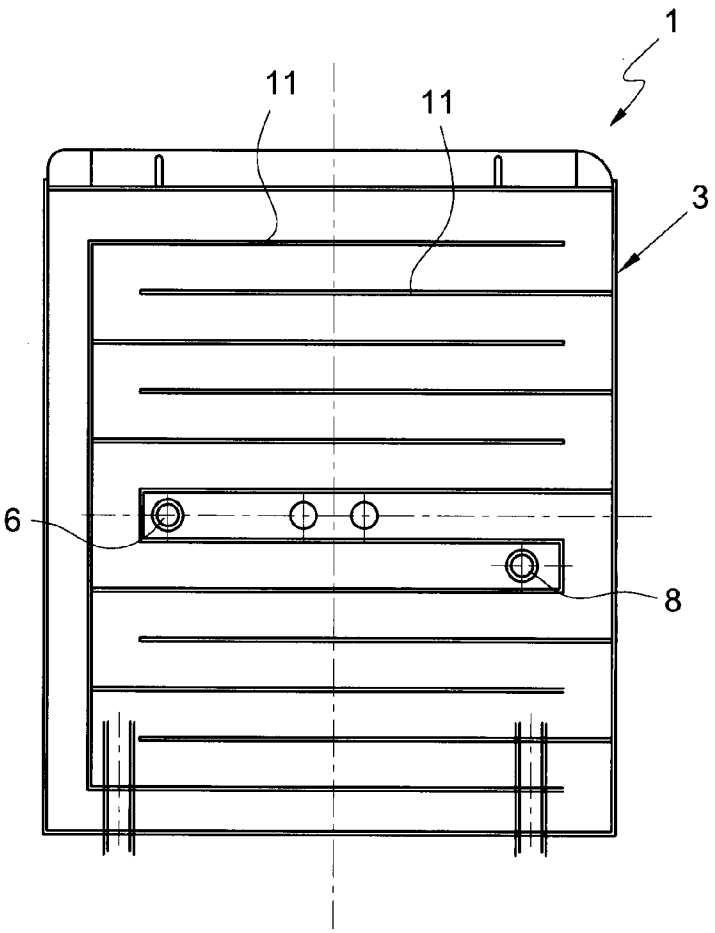
FIG. 3 is a front view of the second chamber of the panel according to the present invention, without the outer closure plate.

With reference to the figures, these show a panel cooled with a fluid for metallurgic furnaces, in particular electric arc-furnaces for the production of steel.

According to a special characteristic of the present invention, the panel 1 comprises two independent cooling circuits in which two different cooling fluids R1 and R2 alternately and selectively operate, one of which is of the "non-explosive" type with respect to the metal bath which is formed inside the furnace. Where, with the expression "non-explosive" it is meant to indicate a cooling fluid which, even if it is incorporated in the metal bath or if it infiltrates in the refractory coating, it does not undergo immediate and sudden increases in volume which cause there to be explosions of the metal bath itself or similar reactions, like what happens for example with water. A "non-explosive" fluid is for example air or another inert gas.

In greater detail, the panel 1 comprises a first chamber 2 and a second chamber 3 that are mutually independent and are alternately and selectively passed by the first cooling fluid R1 and by the second cooling fluid R2, which is different from the first.

The first chamber 2 has a face 2A that, in assembly conditions, is destined to face the interior of a metallurgic furnace F and the opposite face 2B is in thermal contact with a face 3A of the second chamber 3, whose opposed face 3B is destined, in assembly conditions, to face the external part of the furnace F.

The face 2B of the first chamber 2 and the face 3A of the second chamber 3 are, i.e. mutually in direct thermal contact, if not actually defined by the very same wall, without them being separated from one another by any space or without the juxtaposition of any intermediate element between them, so that there is the heat exchange between the first cooling fluid R1 and the second cooling fluid R2 circulating in them.

The first chamber 2 and the second chamber 3 each comprise a respective serpentine duct provided with a respective inlet 5, 6 and with an outlet 7, 8 of a cooling fluid.

Figure 1:
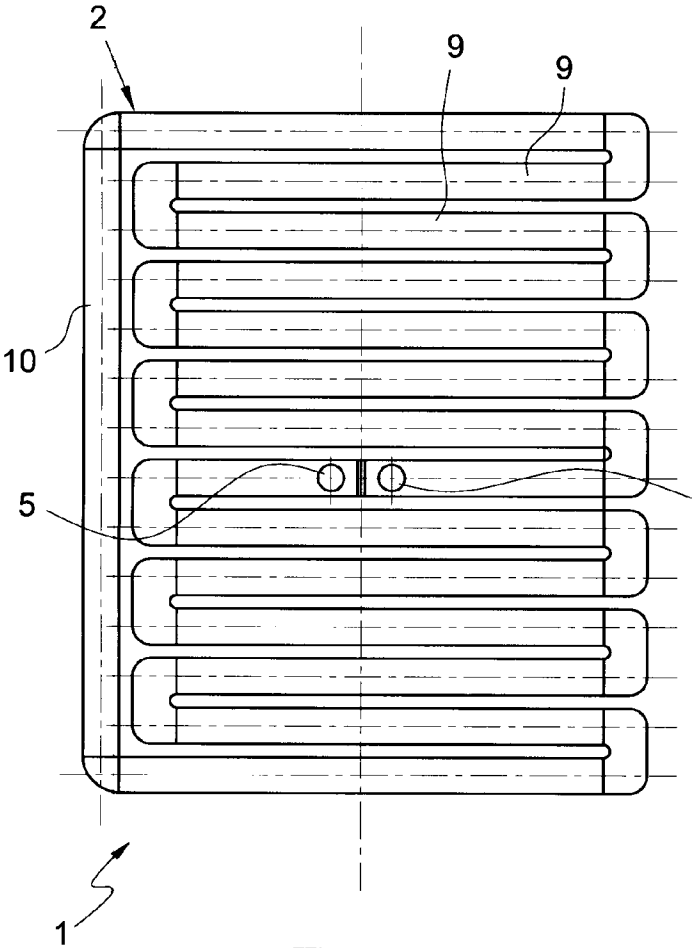
FIG. 1 is a front schematic view of the first chamber of the panel according to the present invention.

The first chamber 2 is defined by a plurality of preferably tubular elements 9 arranged mutually parallel and with a U-connection. As can be seen in FIG. 1, considering the panel 1 in assembly conditions, the inlet 5 and the outlet 7 of the cooling fluid of the first chamber 2 are preferably arranged in a central area of the panel 1 and the tubular elements 9 substantially, but not exclusively, project horizontally. The flow of the cooling fluid firstly follows a course that goes down in the lower half of the first chamber 2 and then, rising back up through the connection duct 10, it follows a course that goes down in the upper half of the first chamber 2.

The second chamber 3 comprises a plurality of sects 11, arranged mutually parallel and staggered, between a first plate 12, defining the face 3B destined, in assembly conditions, to face the external part of the furnace F, and a second plate 13 defining the face 3A in thermal contact with the face 2B of the first chamber 2.

Figure 2:
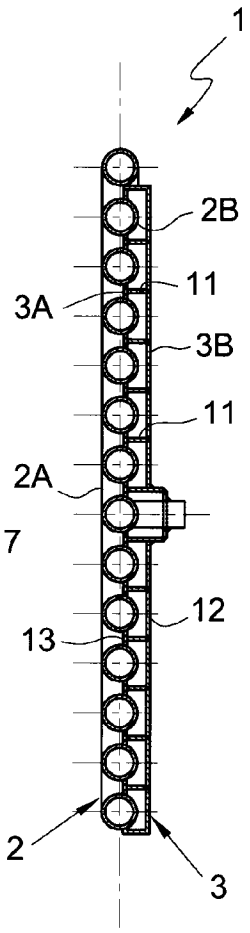
FIG. 2 is a schematic and section view of the panel according to the present invention.

In particular, the second plate 13 is shaped so as to partially house the tubular elements 9 and comprises a plurality of strips arranged between the tubular elements 9 and fixed to them, so that, as can be clearly seen by the section of FIG. 2, part of the surface of the tubular elements 9 is directly licked by the cooling fluid circulating in the second chamber 3 so as to have an efficient heat exchange between the two cooling fluids.

The serpentine duct of the second chamber 3 has an analogous course to that of the serpentine duct of the first chamber 2 and projects substantially parallel to it. Even the arrangement of the inlet 6 and of the outlet 8 of the second chamber 3 is analogous to that of the inlet 5 and of the outlet 7 of the first chamber 2, so that the flow of the cooling fluid that passes through the second chamber 3 follows a course that is analogous to that mentioned above.

As can be easily understood by a man skilled in the art, the form of the serpentine ducts of the first chamber 2 and of the second chamber 3, their relative positions and the position of the inlets 5 and 6 and of the outlets 7 and 8 can be different from those described with reference to one, but not exclusive, possible embodiment as represented in the attached drawings. The tubular elements 9, for example, could have a section that is different from the circular one or could be replaced by channels; the inlets 5 and 6 and the outlets 7 and 8 could be arranged at one end of the panel 1; the serpentine ducts of the first chamber and of the second chamber 3 could be arranged mutually orthogonal or crossed.

The entire panel 1 is realised in a metal, preferably copper.

Both the inlet 5 of the first chamber 2 and the inlet 6 of the second chamber 3 are intended to be arranged in fluid communication both with a first supply line 14 of the first cooling fluid R1, and with a second supply line 15 of the second cooling fluid R2 through respective interception valves 16 and 17.

Analogously, both the outlet 7 of the first chamber 2 and the outlet 8 of the second chamber 3 are intended to be arranged in fluid communication both with a first exhaust line 18 of the first cooling fluid R1, and with a second exhaust line 19 of the second cooling fluid R2 through respective interception valves 20 and 21.

Each of the four interception valves 16, 17, 20 and 21 is of the four-way type and has at least two positions.

As already indicated above, the first cooling fluid R1 and the second cooling fluid R2, which alternately and selectively pass through the first chamber 2 and the second chamber 3, are mutually different and one of them is of the non-explosive type. In the present description it is presumed that the second cooling fluid R2 is of the "non-explosive" type, being it possible, for example, to consist of air or other inert gas, whereas the first cooling fluid R1 is water. It should be specified that the first cooling fluid R1 and the second cooling fluid R2 could be different from water and air, what is important is that one of such two fluids is of the "non-explosive" type.

The panel 1 is intended to be applied to a metallurgic furnace F, in particular an electric arc-furnace for the production of steel, as the component of the walls of the shell, of the roof or of the dome and also of the exhaust gas evacuation duct.

Figure 5:
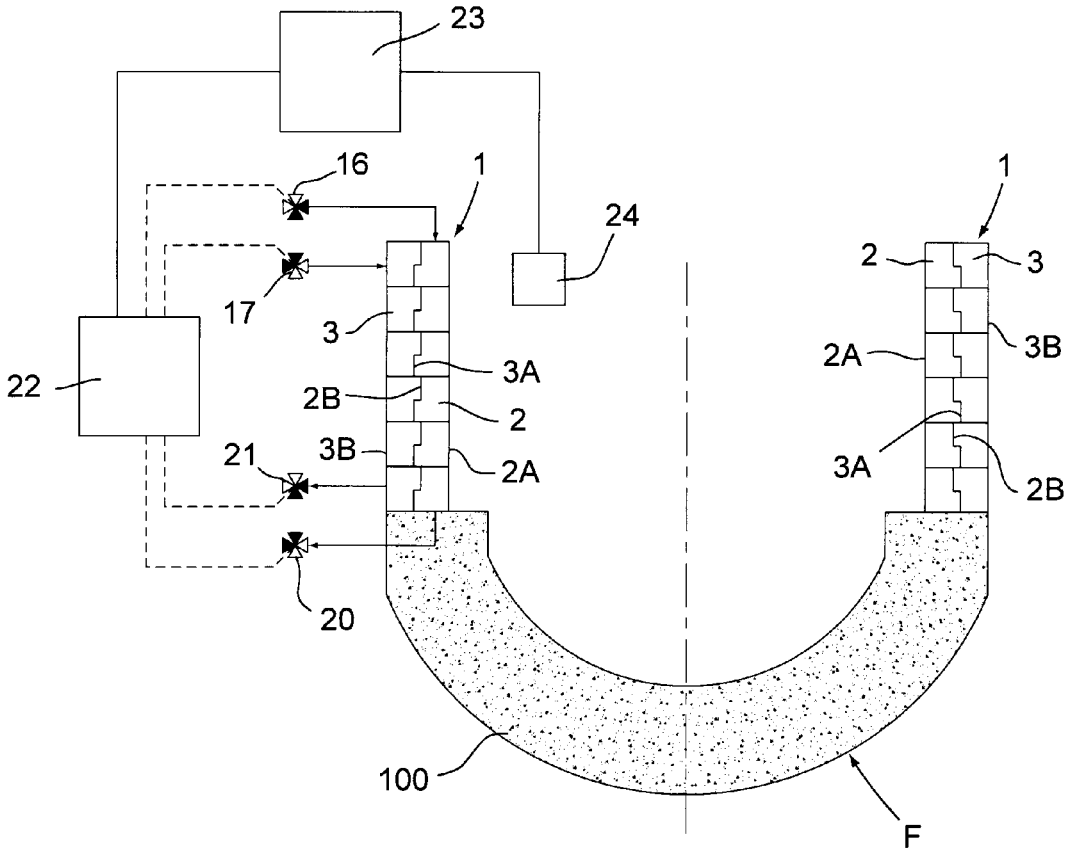
FIG. 5 schematically shows the panel and the cooling system according to the present invention applied to a metallurgic furnace and operating in the first working configuration.
Figure 7:
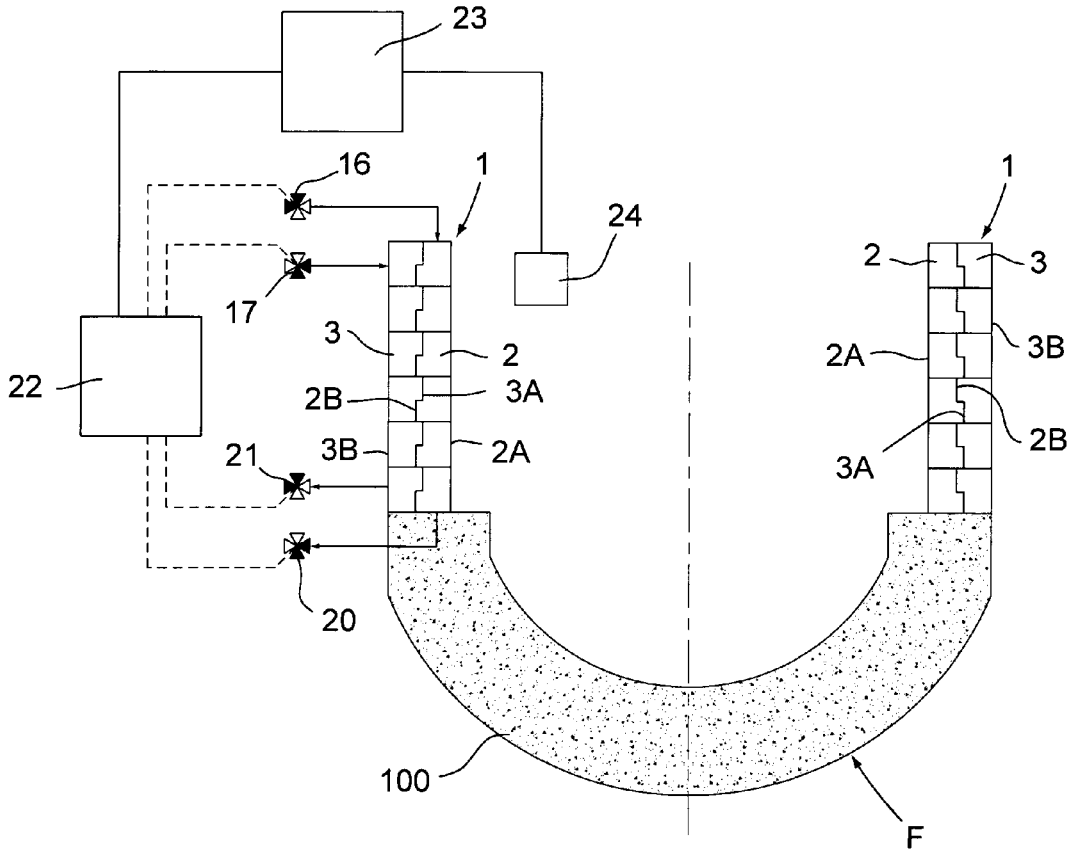
FIG. 7 schematically shows the panel and of the cooling system according to the present invention applied to a metallurgic furnace and operating in the second working configuration.

FIGS. 5 and 7 schematically show a furnace F comprising a basin or crucible 100 in refractory material that is closed at the top by a shell and by a dome (not shown), where the shell is made with a plurality of panels 1 according to the present invention.

Each panel 1 is mounted so that the face 2A of the first chamber 2 faces the interior of the furnace F and the face 3B of the second chamber 3 faces the external part of the furnace F.

According to the present invention, the cooling of the walls of the furnace F, or better, of the shell of the furnace F, occurs by making the first cooling fluid R1 pass through the first chamber 2 and by making the second cooling fluid R2 pass through the second chamber 3, detecting, in a manner that may or may not be continuous with systems and devices known by a man skilled in the art, possible leakages of the first cooling fluid R1 from the first chamber 2.

If, such a leakage is detected, the flows of the first and of the second cooling fluid R1 and R2 are inverted making the second cooling fluid R2 pass through the first chamber 2 and by making the first cooling fluid R1 pass through the second chamber 3.

In greater detail, in working conditions, the panel 1 takes up two working configurations which are schematised in FIGS. 4-5 and 6-7, respectively. It should be specified that, for the sole purpose of greater clarification of the representation, in FIGS. 4 and 6 the first chamber 2 and the second chamber 3 of the panel 1 have been represented only schematically and mutually separated; whereas in FIGS. 5 and 7 the supply lines 14, 15 and the exhaust lines 18, 19 have been omitted.

In a first working configuration (FIGS. 4 and 5), that which is generally adopted during the operation of the furnace F, the first chamber 2 is passed by the first cooling fluid R1 (water) and the second chamber 3 is passed by the second cooling fluid R2 (air).

The interception valve 16 connecting the first supply line 14 and the second supply line 15 to the inlet 5 of the first chamber 2, indeed, is in a position such as to allow the flow from the first supply line 14 to the first chamber 2, preventing the flow from the second supply line 15 to the first chamber 2.

Correspondingly, the interception valve 20 that connects the outlet 7 of the first chamber 2 to the first exhaust line 18 and to the second exhaust line 19 is in a position such as to allow the flow from the first chamber 2 towards the first exhaust line 18, preventing that towards the second exhaust line 19.

Analogously, the interception valve 17 that connects the first supply line 14 and the second supply line 15 to the inlet 6 of the second chamber 3 is in a position such as to allow the flow from the second supply line 15 to the second chamber 3, preventing the flow from the first supply line 14 to the second chamber 3.

Correspondingly, the interception valve 21 that connects the outlet 8 of the second chamber 3 to the first exhaust line 18 and to the second exhaust line 19 is in a position such as to allow the flow from the second chamber 3 towards the second exhaust line 19, preventing that towards the first exhaust line 18.

In such a first working configuration, therefore, the first cooling fluid R1 (water) circulates in the first chamber 2, that which directly faces the interior of the furnace F, and the second cooling fluid R2 (air) circulates in the second chamber 3, that which faces the external part of the furnace F.

Both the first and the second cooling fluid R1 and R2, although with different efficiency, having different heat capacity (greater for water and lower for air), contribute towards the heat exchange between the environment inside the furnace F and outside of the panel 1, thanks to the thermal contact between the first chamber 2 and the second chamber 3.

As it is known, the portion of the panel 1 (the first chamber 2) that faces the interior of the furnace F cyclically undergoes mechanical, thermal and chemical stress, which can jeopardise its integrity leading, for example, to the formation of cracks and fissures through which the first cooling fluid R1 (water) can leak entering into contact with the metal bath generating possible danger of explosions.

If, with known systems and devices, a leakage of the first cooling fluid R1 is detected and indicated inside the furnace F, the panel 1 is made to operate in a second working configuration that is opposite with respect to the first, i.e. in which, the first cooling fluid R1 (water) is made to circulate in the second chamber 3 and the second cooling fluid R2 (air), that which is "non-explosive", is made to circulate in the first chamber 2.

In such a second working configuration (FIGS. 6 and 7), the interception valves 16, 17, 20 and 21 take up the position opposite to that which they take up in the first aforementioned working configuration.

In particular, the interception valve 16 that connects the first supply line 14 and the second supply line 15 to the inlet 5 of the first chamber 2, indeed, is in position such as to obstruct the flow from the first supply line 14 to the first chamber 2, allowing, on the other hand, the flow from the second supply line 15 to the first chamber 2.

Correspondingly, the interception valve 20 that connects the outlet 7 of the first chamber 2 to the first exhaust line 18 and to the second exhaust line 19, is in a position such as to prevent the flow from the first chamber 2 towards the first exhaust line 18 and allow, on the other hand, that towards the second exhaust line 19.

Analogously, the interception valve 17 that connects the first supply line 14 and the second supply line 15 to the inlet 6 of the second chamber 3 is in a position such as to prevent the flow from the second supply line 15 to the second chamber 3 and allow, on the other hand, the flow from the first supply line 14 to the second chamber 3.

Correspondingly, the interception valve 21 that connects the outlet 8 of the second chamber 3 to the first exhaust line 18 and to the second exhaust line 19 is in a position such as to prevent the flow from the second chamber 3 towards the second exhaust line 19 and such as to allow that towards the first exhaust line 18.

In such a second working configuration, therefore, in the first chamber 2, that which directly faces the interior of the furnace F and that has suffered structural damage, the second cooling fluid R2 (air), that which is "non-explosive" circulates, so that possible leakages thereof inside the furnace F do not generate any condition of possible danger.

In the second chamber 3, that facing the external part of the furnace F, on the other hand, the first cooling fluid R1 (water) circulates.

It should also be noted that in such a second working condition, thanks to the thermal contact between the face 2A of the first chamber 2 and the face 3A of the second chamber 3, mutually in contact or defined by the same wall, which ensures an efficient heat exchange between the first and the second cooling fluids R1 and R2, there is an efficient heat exchange between the interior of the furnace F and outside of the panel 1, despite the fact that the second cooling fluid R2 (air), which circulates in the first chamber 2, generally has a heat capacity that is lower with respect to the first cooling fluid R1 (water).

Indeed, thanks to the high thermal conductivity of the metal with which the panel 1 is made and to the thermal contact between the first chamber 2 and the second chamber 3, the heat absorbed by the second cooling fluid R2, which circulates in the first chamber 2, is transmitted to the first cooling fluid R1 (water), which circulates in the second chamber 3.

Such a condition limits the damage that the panel 1 could suffer if a failure thereof is detected during a critical working step of the furnace (for example, tapping) which cannot be interrupted.

If water panels of the known type have suffered damage during a critical working step of the furnace, they become inactive, interrupting the flow of water directed to them. This, as mentioned, exposes them to serious thermal stress which damages them beyond repair.

On the other hand, the panel 1 according to the present invention, thanks to the inversion of the flow of the first cooling fluid R1 (water) and of the second cooling fluid R2 (air) between the first chamber 2 and the second chamber 3, remains operative ensuring a good heat exchange in safety conditions of the furnace.

Indeed, in both working conditions, two watertight and closed cooling circuits that can be switched with one another are simultaneously active.

It should be noted, moreover, that, in such a second working configuration, by making the second cooling fluid R2 (air), i.e. that which is "non-explosive", circulate in the first chamber 2, that which directly faces the interior of the furnace F and that has suffered structural damage, the first chamber 2 is completely emptied out by the first cooling fluid R1 (water) and any possible residue of such a first cooling fluid R1 (water) is completely eliminated, preventing it, therefore, from being able to leak inside the furnace F. Any potential risk of explosion is thus avoided.

Figure 4:
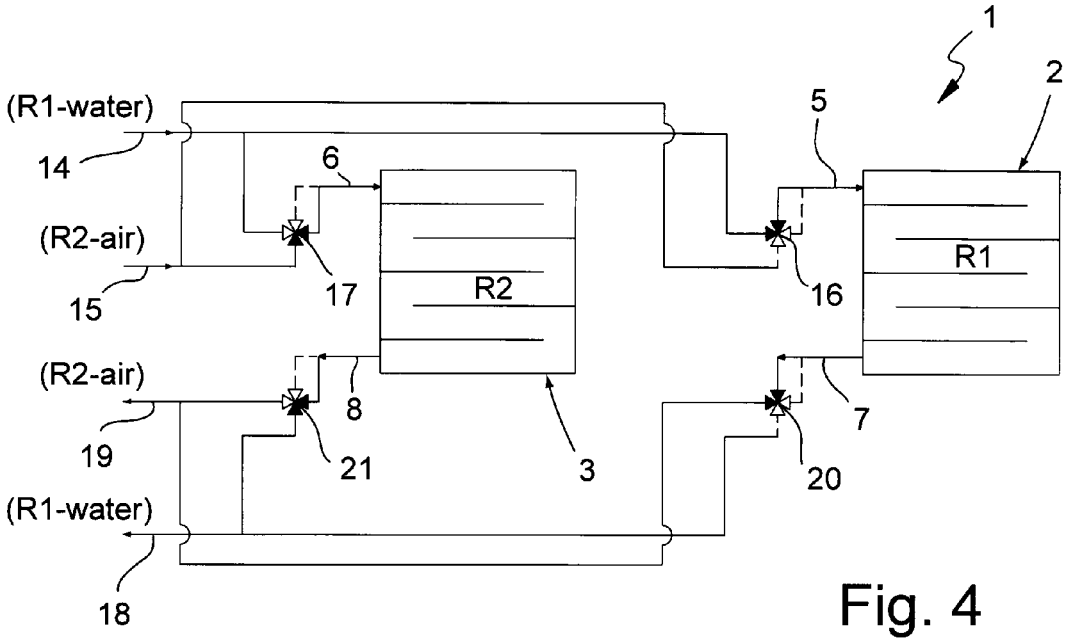
FIG. 4 is an overview of the panel and of the cooling system according to the present invention in a first working configuration.
Figure 6:
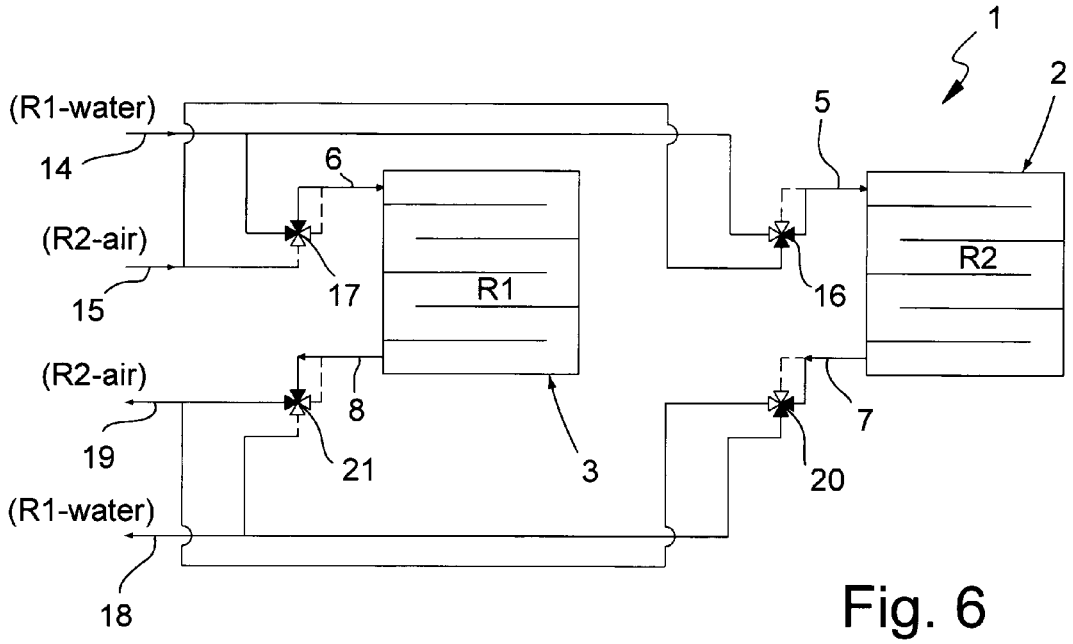
FIG. 6 is an overview of the panel and of the cooling system according to the present invention in a second working configuration.

FIGS. 5 and 7 schematically represent the cooling system according to FIGS. 4 and 6 complete with a possible control device 22 of the interception valves 16, 17, 20 and 21 and in turn controlled by a control and pilot unit 23 according to the signals detected by a system 24 for detecting leakages of the first cooling fluid R1 from the first chamber 2.

The system 24 for detecting the leakages of the first cooling fluid R1 can be one of the various systems currently known and does not form the object of the present invention. For example, it could comprise devices for measuring the flow rate, the pressure and the temperature of the first cooling fluid R1 circulating in the first chamber 2 or be based upon the analysis of the exhaust gases of the furnace.

Furthermore, as can easily be understood by a man skilled in the art, the cooling system is completed by basins for supplying and collecting the cooling fluids, heat exchangers, pumps, compressors, valves and other adjustment and control devices which are not described and represented in detail, since they can be of various types and be arranged in different circuit configurations.

Analogously, in the present description and in the attached figures further particulars of the furnace have not been described in detail, like for example, the electrodes, the support cradles, the tapping channel and similar, since they are known to the man skilled in the art and are not part of the present invention.

In practice it has been noticed how the present invention achieves the predetermined purposes.

The panel cooled with a fluid and the cooling system of a metallurgic furnace incorporating such a panel, indeed make it possible to lengthen the average life span and to limit the damage and to reduce the costs for repairing the panel itself with respect to panels, cooled with water, of the known type.

Indeed, if the panel according to the present invention, operating in usual conditions—i.e. in the first working configuration in which the first cooling fluid (water) circulates in the first chamber and the second cooling fluid (air) circulates in the second chamber—suffers damage detected during any working step of the furnace, even a critical step that cannot be interrupted, the flows of the first cooling fluid and of the second cooling fluid are reversed and the panel remains operative, ensuring a good heat exchange between the interior of the furnace and outside the panel.

This limits the damage suffered by the panel according to the present invention with respect to those suffered by panels cooled with water of the known type, which, if damaged in a critical working step of the furnace, become inoperative until the operation cycle of the furnace itself has been completed, with consequent possible complete and irreparable damage.

The panel and the cooling system according to the present invention, moreover, make it possible to limit maintenance operations and to plan them only for the inactive steps of the furnace, avoiding the requirement of sudden and prolonged interruptions of production.

The panel and the cooling system according to the present invention, moreover, allow the continuity of operation of the furnace in safe conditions even when there is a leakage of the cooling fluid inside the furnace.

Indeed, if, from the first working configuration of the panel according to the present invention, in which the first cooling fluid (water) circulates in the first chamber (that facing the interior of the furnace) and the second "non-explosive" cooling fluid (air) circulates in the second chamber (the one facing outside with respect to the furnace), there is a leakage of the first cooling fluid inside the furnace, it is sufficient to reverse the flows of the first and of the second cooling fluid in the first and in the second chamber, keeping the furnace operative in safe conditions.

Indeed, with such an inversion, in the first chamber of the panel according to the present invention, i.e. the chamber facing the interior of the furnace and that has suffered damage (cracks, fissures or similar), the second cooling fluid, fluid which is selected from the "non-explosive" ones, circulates, like, for example, air or other inert gas, so that a leakage thereof inside the furnace does not generate any condition of potential danger.

The flow of such a second cooling fluid (air) in the first damaged chamber of the panel according to the present invention eliminates, moreover, any residue of the first cooling fluid (water) in it, eliminating the risk of such residues being able to leak into the furnace.

The two flows of the first and of the second cooling fluid, thanks to the thermal contact between the first chamber and the second chamber and to the high thermal conductivity of the metal with which the panel according to the present invention is made, also ensure an efficient heat exchange and cooling of the furnace.

The panel cooled with a fluid and the cooling system incorporating such a panel for metallurgic furnaces thus conceived can undergo numerous modifications and variants, all covered by the invention; moreover, all the details can be replaced by technically equivalent elements. In practice the materials used, as well as the sizes, can be any according to the technical requirements.

The invention claimed is:

1. A method for cooling walls of a metallurgic furnace including a basin made from refractory material for containment of a metal to be treated and from a peripheral edge of which a shell arises, the shell being closed at a top by a roof, wherein at least one of the shell and the roof includes at least one panel in turn including a first chamber including a face facing towards an interior of the metallurgic furnace and an opposite face being in direct mutual thermal contact with a face of a second chamber whose opposed face faces an external part of the metallurgic furnace, wherein the first chamber and the second chamber are mutually independent, and wherein the first chamber includes an inlet and an outlet of a cooling fluid and the second chamber includes an inlet and an outlet of a cooling fluid, the method comprising:

making a first cooling fluid pass through the first chamber and making a second cooling fluid, that is different from the first cooling fluid, pass through the second chamber;

detecting leakages of the first cooling fluid from the first chamber;

when the leakages are detected, inverting the first cooling fluid and the second cooling fluid by making the second cooling fluid pass through the first chamber and by making the first cooling fluid pass through the second chamber, wherein the first cooling fluid is an explosive fluid and the second cooling fluid is a non-explosive fluid in inner working conditions of the metallurgic furnace.

2. The method according to claim 1, wherein the first cooling fluid is water and the second cooling fluid is air or an inert gas.

3. The method according to claim 1, wherein a first supply line of the first cooling fluid and a second supply line of the second cooling fluid are both in fluid communication with the inlet of the first chamber and the second chamber by a first set of interception valves individually corresponding to the first and second supply lines, and a first exhaust line of the first cooling fluid and a second exhaust line of the second cooling fluid are both in fluid communication with the outlet of the first chamber and the second chamber by a second set of interception valves individually corresponding to the first and second exhaust lines.

4. The method according to claim 3, further comprising:

controlling the first set of interception valves between a first position and a second position thereof, and controlling the second set of interception valves between a third position and a fourth position thereof, wherein the at least one panel has a first working configuration in which the first cooling fluid pass through the first chamber and the second cooling fluid pass through the second chamber, the at least one panel has a second working configuration in which the second cooling fluid pass through the first chamber and the first cooling fluid pass through the second chamber, the first position and the third position correspond to the first working configuration of the at least one panel, and the second position and the fourth position correspond to the second working configuration of the panel.

5. The method according to claim 3, wherein each of the first set of interception valves and the second set of interception valves comprises a four-way and at least two positions direction valve.

6. The method according to claim 4, wherein at the first position, the first supply line of the first cooling fluid supplies the first chamber, but not the second chamber, and the second supply line of the second cooling fluid supplies the second chamber but not the first chamber, at the second position, the first supply line of the first cooling fluid supplies the second chamber, but not the first chamber, and the second supply line of the second cooling fluid supplies the first chamber, but not the second chamber, at the third position, the outlet of the first chamber is in communication with the first exhaust line of the first cooling fluid, but not with the second exhaust line of the second cooling fluid, and the outlet of the second chamber is in communication with the second exhaust line of the second cooling fluid, but not with the first exhaust line, and at the fourth position, the outlet of the first chamber is in communication with the second exhaust line of the second cooling fluid, but not with the first exhaust line, and the outlet of the second chamber is in communication with the first exhaust line of the first cooling fluid, but not with the second exhaust line.

7. The method according to claim 4, wherein the first chamber and the second chamber each comprise a respective serpentine duct connected to respective inlet of the first cooling fluid and the second cooling fluid and to respective outlet of the first cooling fluid and the second cooling fluid.

8. The method according to claim 7, wherein the serpentine ducts substantially have a same course and are substantially and mutually parallel or orthogonal.

9. The method according to claim 7, wherein the serpentine duct of the first chamber is defined by a plurality of tubular elements with a U-connection.

10. The method according to claim 7, wherein the serpentine duct of the second chamber is defined by a plurality of sects juxtaposed between a first plate defining the face configured, in the assembly conditions, to face the external part of the metallurgic furnace and a second plate shaped to house the tubular elements.

* * * * *